US006592716B1

(12) United States Patent
Kim et al.

(10) Patent No.: US 6,592,716 B1
(45) Date of Patent: Jul. 15, 2003

(54) SECURITY FIBERS AND PROCESS FOR THE PREPARATION THEREOF

(75) Inventors: Jong-Kyu Kim, Taejon (KR); Yong-Hwan Park, Taejon (KR)

(73) Assignee: Korea Security Printing and Minting Corporation, Taejon (KR)

( * ) Notice: Subject to any disclaimer, the term of this patent is extended or adjusted under 35 U.S.C. 154(b) by 0 days.

(21) Appl. No.: 09/623,863

(22) PCT Filed: Feb. 16, 1999

(86) PCT No.: PCT/KR99/00087

§ 371 (c)(1),
(2), (4) Date: Sep. 1, 2000

(87) PCT Pub. No.: WO99/45200

PCT Pub. Date: Sep. 10, 1999

(30) Foreign Application Priority Data

Mar. 2, 1998 (KR) ..... 1998-6705

(51) Int. Cl.[7] ..... D21M 21/40

(52) U.S. Cl. ..... 162/140; 162/146; 162/162; 8/479; 8/481; 8/482; 57/200; 57/243; 57/309

(58) Field of Search ..... 162/140, 146, 162/162; 57/243, 200, 309; 8/479, 481, 482

(56) References Cited

U.S. PATENT DOCUMENTS

| | | | | | |
|---|---|---|---|---|---|
| 689,559 | A | * | 12/1901 | Meyer | 8/479 |
| 1,913,410 | A | * | 6/1933 | Rivat | 8/479 |
| 2,208,653 | A | * | 7/1940 | Whitehead | 162/140 |
| 2,430,153 | A | * | 11/1947 | Womble et al. | 8/479 |
| 3,153,106 | A | * | 10/1964 | Schlick | 8/481 |

FOREIGN PATENT DOCUMENTS

| | | | | |
|---|---|---|---|---|
| FR | 2593840 | * | 8/1987 | 162/140 |

* cited by examiner

*Primary Examiner*—Peter Chin
(74) *Attorney, Agent, or Firm*—Katten Muchin Zavis Rosenman

(57) ABSTRACT

Security fibers having enhanced antifalsification features are prepared by a process which comprises the steps of: i) braiding 5 to 30 denier fibers to form a twine; ii) dyeing the twine with a dye or pigment; iii) drying the dyed twine; and then iv) cutting the dried twine to give the security fibers in the form of cut fibers.

7 Claims, 4 Drawing Sheets

SECURITY FIBERS AND PROCESS FOR THE PREPARATION THEREOF

FIELD OF THE INVENTION

The present invention relates to security fibers, a process for the preparation thereof and a security paper containing same.

BACKGROUND OF THE INVENTION

Security documents such as bank notes, stocks, bonds, checks, warrants and identification cards need to be guarded by antifalsification measures and they are often made from a security paper having a security element in the form of fibers, strips or threads embedded therein.

Japanese Laid-open Patent Application No. 90-293500 discloses a security paper containing security fibers prepared by dyeing a natural or synthetic fiber uniformly with a visible or invisible fluorescent dye and cutting the dyed fiber to a given length. However, such monochromatic security fibers have limited effectiveness in the prevention of counterfeiting.

Korean Patent No. 111,723 describes multi-colored security fibers prepared by a process comprising the steps of: placing a mask over a section of a fiber and dyeing the exposed section of the fiber with a first dye; replacing the mask over to the dyed section thereby exposing the undyed section; dyeing the undyed section of the fiber with a second dye; and cutting the fiber to a suitable length to obtain multi-colored security fibers having an enhanced security feature.

However, this complicated process has a low productivity.

SUMMARY OF THE INVENTION

Accordingly, it is a primary object of the present invention to provide an improved process for preparing security fibers suitable for use in a security paper.

It is another object of the present invention to provide novel security fibers suitable for use in a security paper.

It is still another object of the present invention to provide a security paper containing security fibers having an enhanced security features.

In accordance with one aspect of the present invention, there is provided a process for preparing security fibers which comprises the steps of: i) braiding 5 to 30 denier fibers to form a twine; ii) dyeing the twine with a dye or pigment; iii) drying the dyed twine; and iv) cutting the dried twine to give the security fibers in the form of cut fibers.

BRIEF DESCRIPTION OF THE DRAWINGS

The above and other objects and features of the present invention will become apparent from the following description of the invention, when taken in conjunction with the accompanying drawings, in which.

DETAILED DESCRIPTION OF THE INVENTION

Figure 1:
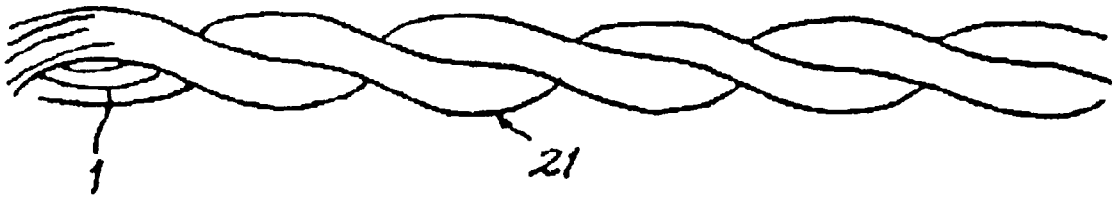
FIG. 1 shows a schematic diagram of braided fibers in the form of a two-thread twisted twine.
Figure 2:
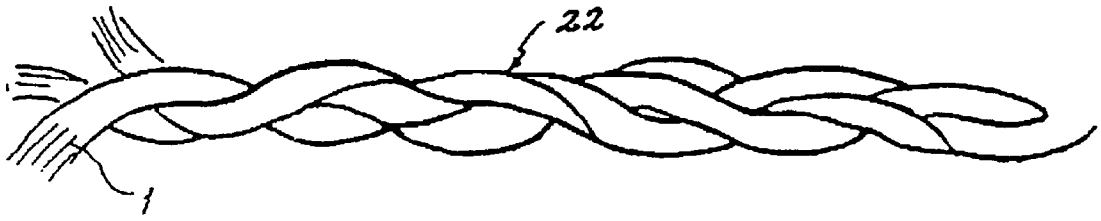
FIGS. 2 depicts a schematic diagram of braided fibers in the form of a three-thread twine.

In practicing the present invention, a 5 to 30 denier fiber 1, which may be any one conventionally used in the art including natural fibers and synthetic fibers such as polyamide, rayon, polyester and cotton thread, may be braided in the form of a two-thread twisted twine 21 as shown in FIG. 1, a three-thread twine 22 as illustrated in FIG. 2, a twine twisted around a suitable pad, e.g., a wire, a twisted twine with a marking band and the like.

The braided fibers are dyed with a dye or pigment in a conventional manner. Exemplary dye or pigment which may be used in the present invention may be any one conventionally used in the art including acid dyes and direct dyes such as Acid Blue AS, Acid Rhodamine B, Uvitex, Papilion Yellow F, TBF(terasile brilliant flavine) and GFF.

The braided fibers dyed in accordance with the present invention have various shades of color because each fiber is partially masked by other fiber(s) and sections thereof are dyed to different shades depending on the degree of masking.

Figure 3:
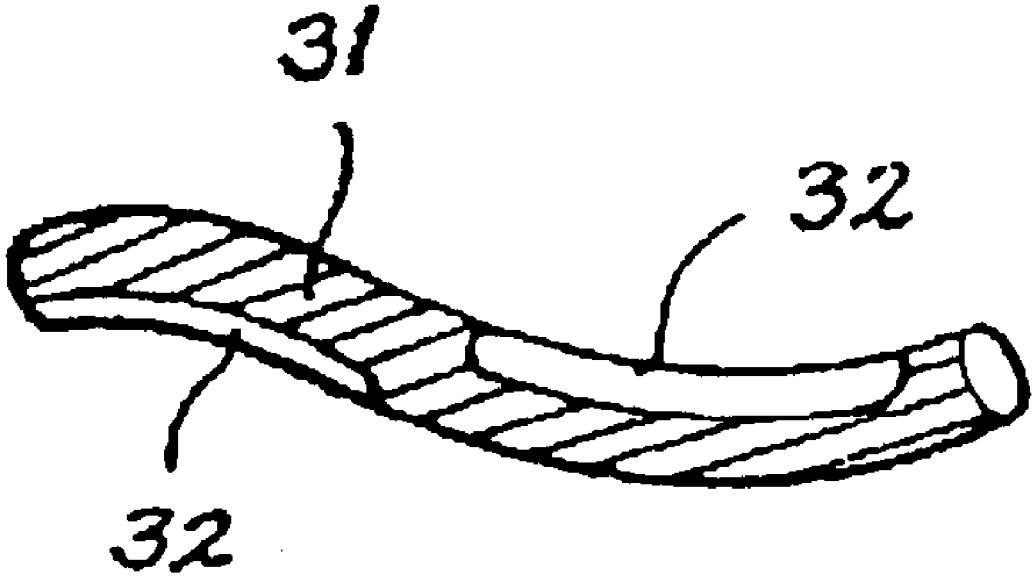
FIG. 3 demonstrates one embodiment of the security fibers prepared in accordance with the present invention.

The shades of color in a fiber can be controlled by adjusting the extent of twist torsion and dyeing time. When the twist strength is high and the dyeing time is short, the area of the twisted fiber which is tightly shielded by other fibers may remain undyed as shown in FIG. 3 wherein the portion 31 is dyed whereas the portion 32 is not dyed.

The dyed fiber may be cut by using any of the conventional method well known in the art to a given length, preferably 3 to 6 mm.

In practicing the present invention, the dyed and cut fiber may be further dyed with another dye/pigment to obtain fibers having various shades of two or more colors. The dye/pigment suitable for use in the second dyeing step may be any one conventionally used in the art including acid dyes and direct dyes such as Acid Blue AS, Acid Rhodamine B, Uvitex, Papilion Yellow F, TBF(terasile brilliant flavine) and GFF.

When the second dyeing process is carried out at a high temperature, e.g., from 80 to 100° C., the fiber may be transformed into an S-shaped form, thereby enhancing its anti-counterfeiting feature.

The security fibers having varying color shades prepared in accordance with the present invention may be used in manufacturing a security paper by employing any of the conventional papermaking method well known in the art.

Figure 4:
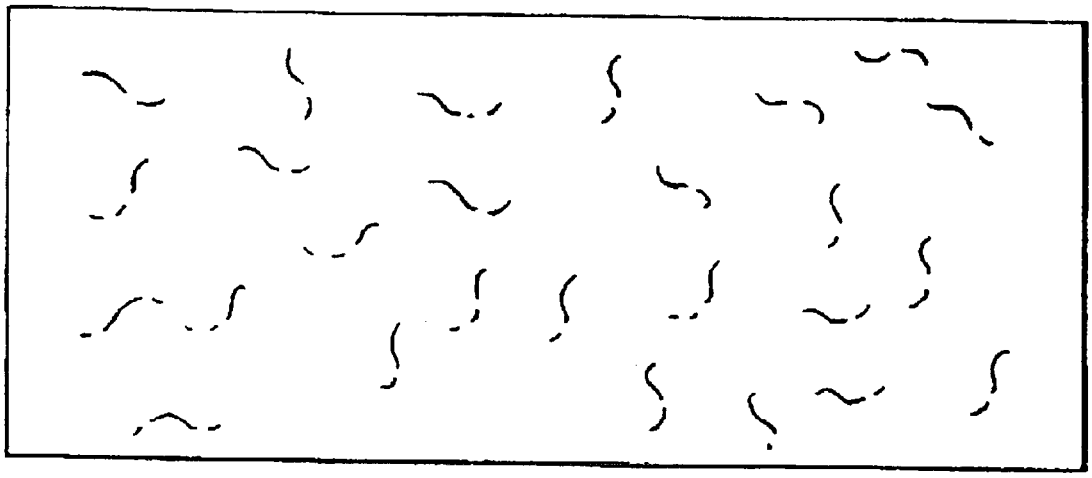
FIG. 4 illustrates one embodiment of the inventive security paper containing embedded security fibers prepared in accordance with the present invention.

For example, the security fibers of the present invention may be mixed with papermaking materials to provide a security paper containing the security fibers uniformly dispersed therein as illustrated in FIG. 4.

The following Examples are intended to further illustrate the present invention without limiting its scope.

EXAMPLE 1

Preparation of Security Fiber 20 denier polyamide fiber was braided in the form of two-thread twine as shown in FIG. 1.

Acid Blue AS was dissolved in water at pH 4–5 to a concentration of 1–2 wt % to obtain a dye solution. The braided fiber was added to the dye solution and dyed at about 90° C. for 10–30 minutes, washed thoroughly with warm water and dried. Then, the dyed fiber was cut to a length of 3–5 mm.

The cut fibers above were dyed in a 1–2 wt % TBF solution at about 90° C. for 10–30 minutes, washed thoroughly with water and dried to give security fibers of the present invention.

EXAMPLE 2

Preparation of Security Paper 10 wt % of a mixture of titanium dioxide, white carbon, talc and calcium carbonate, and 0.1–1 wt % epoxy resin were added to a 0.2–1% wood pulp suspension in stock chest to form a paper making stock.

The security fibers obtained in Example 1 were added to the paper making composition obtained above, to a concentration of 0.002–1.0%. The mixture was stirred well and formed into a security paper of 60–100 g/m$^2$.

While the invention has been described with respect to the above specific embodiments, it should be recognized that various modifications and changes may be made to the invention by those skilled in the art which also fall within the scope of the invention as defined by the appended claims.

What is claimed is:

1. A process for preparing security fibers having varying color shades which comprises the steps of: i) braiding 5 to 30 denier fibers to form a twine; ii) dyeing the twine with a dye or pigment to form dyed portions and undyed portions on each fiber; iii) drying the dyed twine; and then iv) cutting the dried twine to give the security fibers in the form of cut fibers.

2. The process of claim 1, further comprising the step of v) dyeing the cut fibers with another dye or pigment after step iv).

3. The process of claim 1, wherein the twine is in the form of a two-threaded plait.

4. The process of claim 1, wherein the twine is in the form of a three-threaded plait.

5. The process of claim 2, wherein the cut fibers are dyed at a temperature ranging from 80 to 100° C.

6. A security fiber prepared by the process of any one of claims 1 to 5.

7. A security paper containing the security fiber prepared by the process of any one of claims 1 to 5.

* * * * *